US006990945B1

(12) United States Patent
Kropinski et al.

(10) Patent No.: US 6,990,945 B1
(45) Date of Patent: Jan. 31, 2006

(54) VEHICLE FUELING ARRANGEMENT

(75) Inventors: Michael A. Kropinski, Troy, MI (US); Thomas E. Bolander, Flint, MI (US); Alexander N. Makris, Ann Arbor, MI (US); Paul A. Bauerle, Fenton, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/891,292

(22) Filed: Jul. 14, 2004

(51) Int. Cl.
*F02B 77/00* (2006.01)

(52) U.S. Cl. ..... 123/198 D; 123/198 DC

(58) Field of Classification Search ..... 123/198 D, 123/198 DC
See application file for complete search history.

(56) References Cited

U.S. PATENT DOCUMENTS 5,329,164 A * 7/1994 Saito ..... 123/198 DC
2003/0150417 A1 * 8/2003 Miwa ..... 123/179.4

FOREIGN PATENT DOCUMENTS

JP 09254670 A * 9/1997

* cited by examiner

*Primary Examiner*—Noah P. Kamen
(74) *Attorney, Agent, or Firm*—Laura C. Hargitt

(57) ABSTRACT

Methods and apparatus are provided for limiting engine operation during fueling. The apparatus comprises, an engine control for enabling or disabling operation of the engine, one or more sensors for detecting whether (i) a cap is on the vehicle fuel fill-pipe, and (ii) a fueling nozzle is in the fuel fill-pipe, a processor coupled to the engine control and the one or more sensors receiving information therefrom and directing the engine control to enable or disable the vehicle engine depending upon the sensor outputs, thereby, disabling the engine when the cap is not on the fill-pipe and/or a fueling nozzle is in the fill-pipe, and enabling the engine when not true. In a further embodiment, a fuel level sensor coupled to the processor is used to detect whether a fuel level change rate $R(t) \geqq Rc$ where Rc is a predetermined value, and if so, disabling the engine.

10 Claims, 6 Drawing Sheets

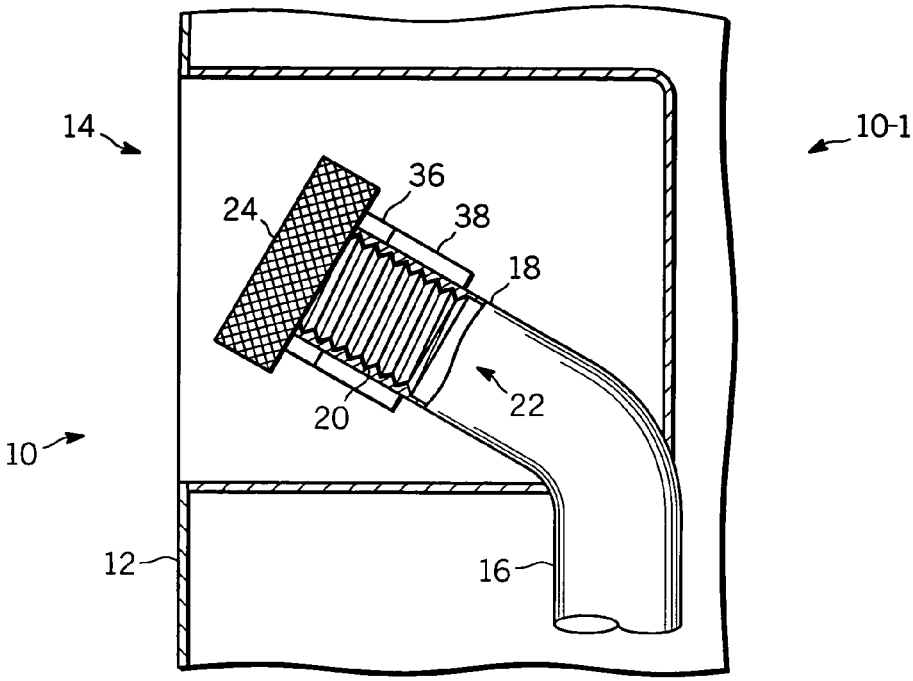
FIG. 1A
FIG. 1B
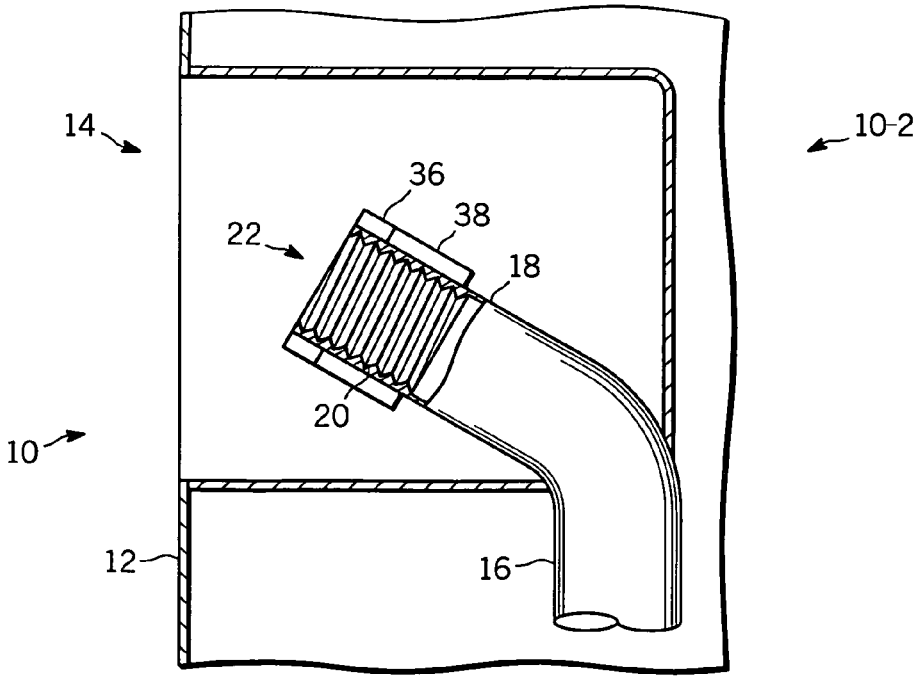

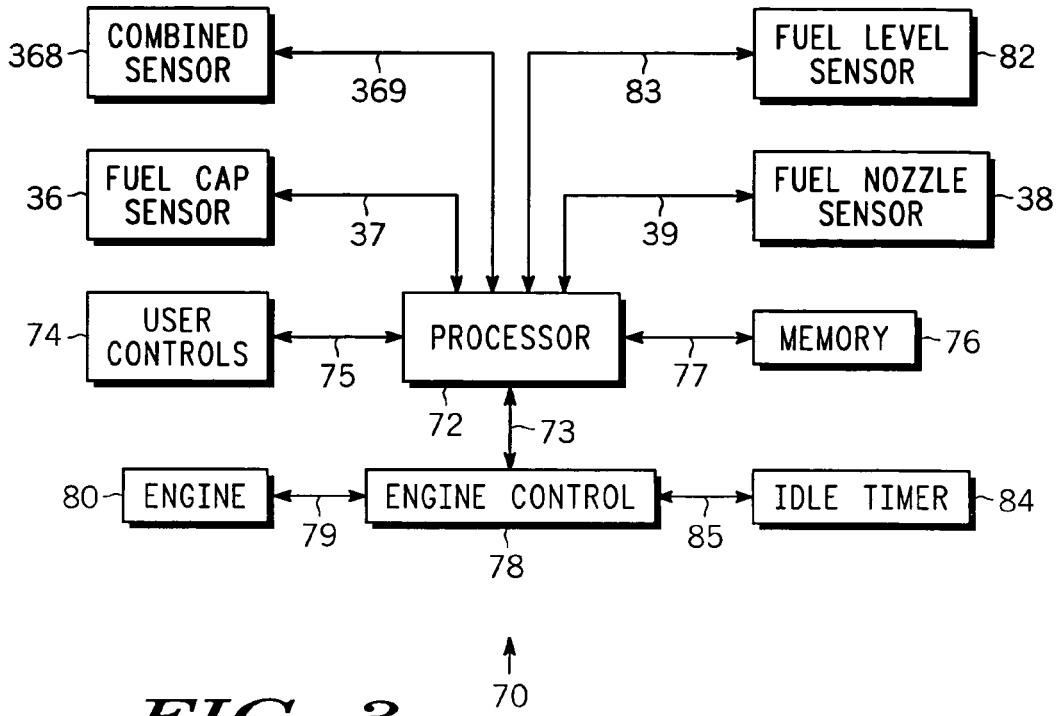
FIG. 3
FIG. 4
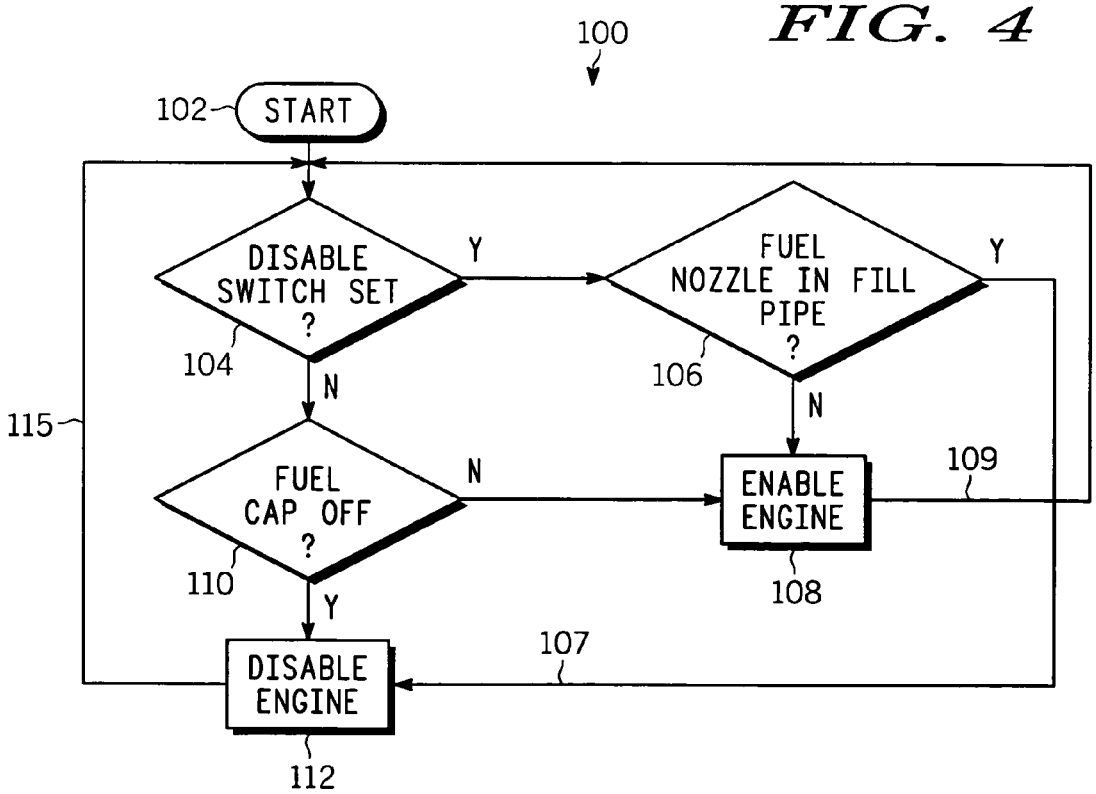

VEHICLE FUELING ARRANGEMENT

TECHNICAL FIELD

The present invention generally relates to vehicle fueling safety, and more particularly relates to inhibiting engine operation during fueling.

BACKGROUND

Most vehicle fueling stations request that engines be turned off during fueling to avoid a risk of fire or explosion due to engine operation igniting fuel vapors associated with the fueling process. This is particularly important when fueling with gasoline. This is a voluntary process that depends upon user cooperation or perhaps station attendant enforcement. However, many fueling stations are now self-service and customers often leave their engines running, especially in cold weather. Thus, there is a need for a system that would insure that engines are automatically disabled during fueling.

Accordingly, it is desirable to provide an apparatus and method that disables the engine when fueling or when fueling is about to take place. In addition, it is desirable that the apparatus and method be automatic so that the engine is disabled during fueling without user action. In addition, it is desirable that the fueling safety system automatically reset when fueling is complete so that the engine can once again be started. Other desirable features and characteristics of the present invention will become apparent from the subsequent detailed description and the appended claims, taken in conjunction with the accompanying drawings and the foregoing technical field and background.

BRIEF SUMMARY

An apparatus is provided for limiting vehicle engine operation during fueling. In a first embodiment, the apparatus comprises, an engine control for enabling or disabling operation of the engine and one or more sensors for detecting whether: (i) a cap is on the vehicle fuel fill-pipe, and (ii) an external fuel supply nozzle is inserted in the vehicle fuel fill-pipe. A processor is provided coupled to the engine control and the sensors. The processor receives information from the sensors and directs the engine control to automatically enable or disable the vehicle engine depending upon the sensor outputs. The engine is disabled when the cap is not on the vehicle fuel fill-pipe, and enabled when the cap is on the fuel fill-pipe. An emergency by-pass switch is desirably included that makes the system insensitive to outcome (i). Under outcome (ii) the vehicle engine is disabled when the external fuel supply nozzle is in the vehicle fill-pipe and enabled when not in the fill-pipe. In a further embodiment that does not require the cap and nozzle sensors, there is provided a fuel level sensor coupled to the processor and an engine idle timer coupled to the engine controller. The engine is shut off if the fuel level changes by a predetermined amount or more. An engine idle timer is preferably used in conjunction with the fuel level sensor.

A method is provided for limiting vehicle engine operation during fueling. In a first embodiment, the method comprises testing whether a fuel-cap by-pass switch is ON (YES) or OFF (NO), and if OFF (NO), determining if the fuel-cap is OFF the fuel fill-pipe of the vehicle. If the fuel fill-pipe cap is ON the fuel fill-pipe, enabling operation of the engine of the vehicle, and if the cap is OFF, disabling operation of the vehicle engine. If the fuel cap by-pass switch is ON (YES), then determining if a fuel supply nozzle is in the fuel fill-pipe of the vehicle, and if YES, disabling operation of the vehicle and if NO, enabling operation of the vehicle. Except for the by-pass switch, the process is automatic and does not require operator intervention. In a further embodiment the cap and nozzle sensors are not needed, but a fuel level sensor and, optionally an engine idle timer, are used to determine the fueling state and engine operating duration. The engine is shut off if the fuel level changes by a predetermined amount or more.

BRIEF DESCRIPTION OF THE DRAWINGS

The present invention will hereinafter be described in conjunction with the following drawing figures, wherein like numerals denote like elements, and FIGS. 1A–1C are simplified partially cut-away and cross-sectional views of a fuel fill-pipe region of a vehicle according to the present invention for three fueling situations;

FIG. 3 is a simplified electrical schematic block diagram of the control system of the present invention for disabling the vehicle engine during fueling;

FIG. 4 is a simplified flow chart of the method of the present invention according to a first embodiment.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1C:
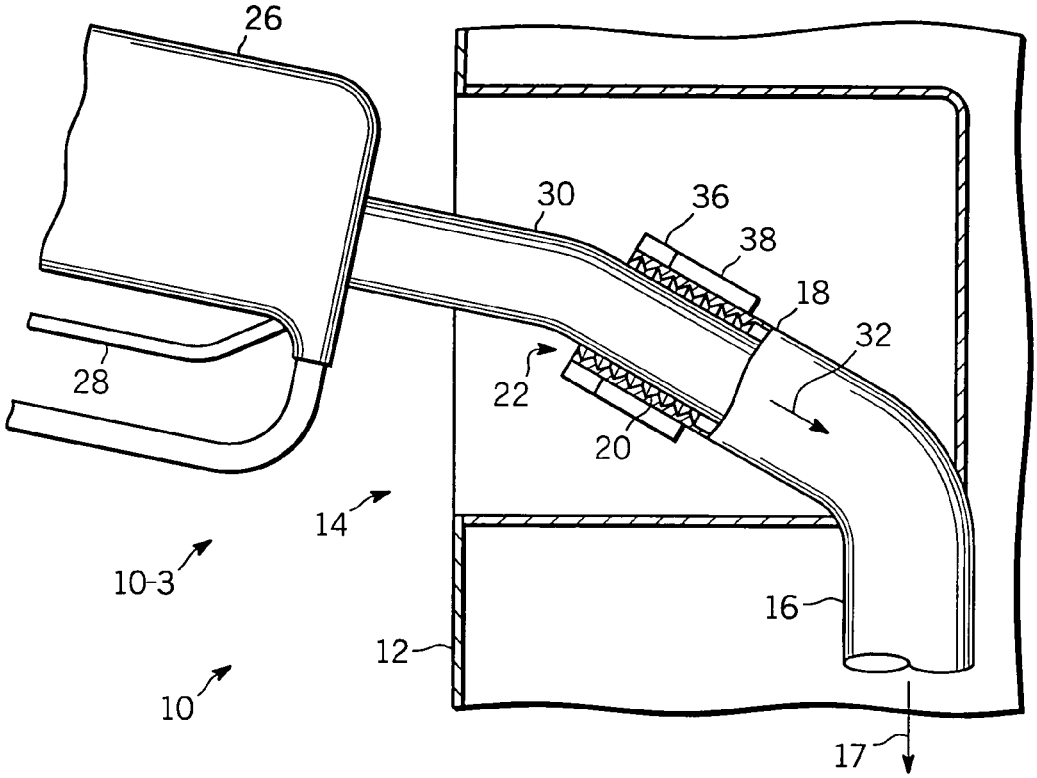

FIGS. 1A–1C are simplified partially cut-away and cross-sectional views of fuel fill-pipe region 10 of a vehicle according to the present invention for three fueling situations 10-1, 10-2, 10-3. Fuel fill-pipe region 10 comprises vehicle body portion 12 having optionally recessed fill-pipe access region 14. Fuel fill-pipe 16 has end region 18 that protrudes into optional access region 14. While fill-pipe access region 14 is desirably recessed to protect end region 18 of fill-pipe 16 from knocks and bumps, this is not essential and end region 18 of fill-pipe 16 may protrude directly from vehicle body 12 without recess 14. End region 18 of fill-pipe 16 has opening 22 with threaded region 20 into which fuel fill-pipe cap 24 may be screwed or otherwise installed to contain fuel vapors within the fuel tank. The use of threads 22 for fuel fill-pipe cap 24 is convenient but not essential and the placement of the threads is not critical. Any means of closing opening 22 of end region 18 of fuel fill-pipe 16 may be used.

Figure 2A:
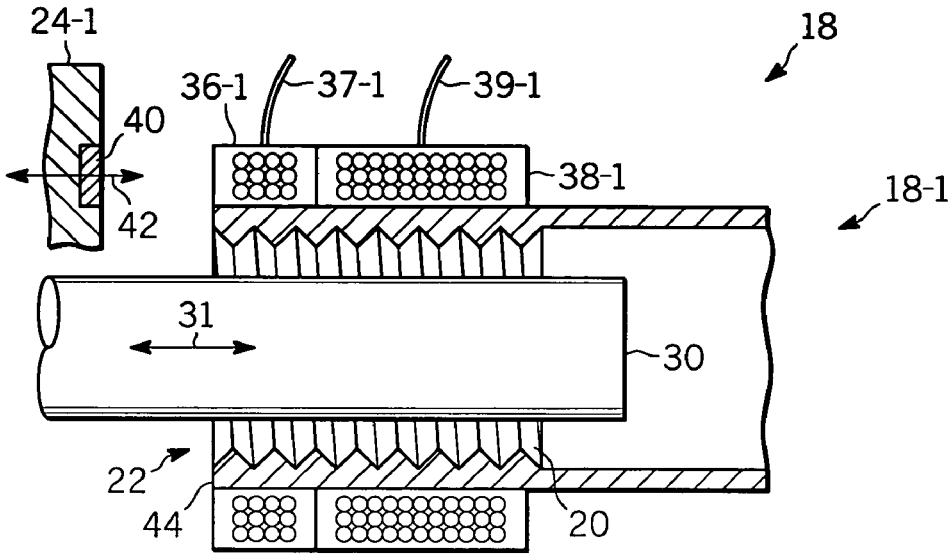
FIGS. 2A–D show enlarged portions of the fuel fill-pipe arrangement of FIGS. 1B–1C providing further details according to several embodiments of the present invention.
Figure 2B:
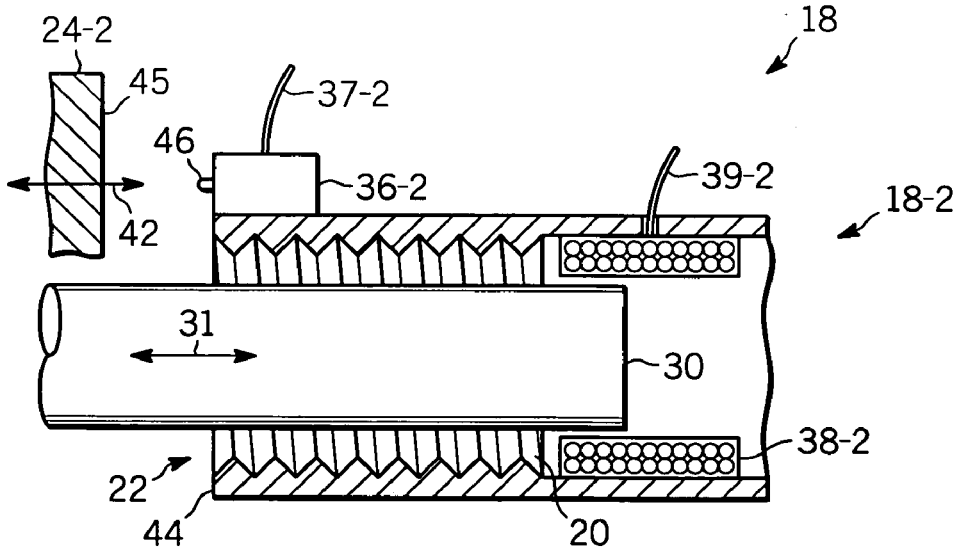
Figure 2C:
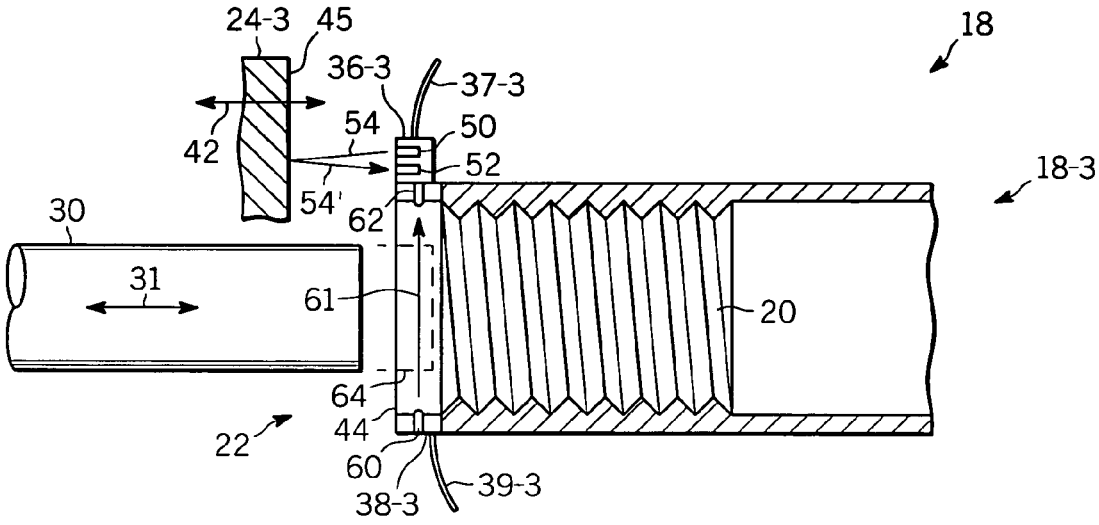

Fuel fill-pipe situation 10-1 of FIG. 1A shows fuel fill-pipe 16 with opening 22 closed by fuel fill-pipe cap 24. In this case it is assumed that cap 24 screws into threads 20 of fuel fill-pipe 16, but this is not essential. Any means of attaching cap 24 to fuel fill-pipe 16 may be used. Cap 24 blocks opening 22 so that no significant fuel vapors can escape from the vehicle fuel tank (not shown). Fuel fill-pipe situation 10-2 of FIG. 1B shows the same fuel fill-pipe but with fuel fill-pipe cap 24 removed. Fuel fill-pipe situation 10-3 shown in FIG. 1C shows fuel fill-pipe 16 with cap 24 removed and fueling apparatus 26 having fueling nozzle 30 inserted in opening 22 of fuel fill-pipe 16. Fueling apparatus 26 has ON/OFF trigger 28 and fueling nozzle 30. Nozzle 30 penetrates opening 22 into end region 18 of fuel fill-pipe 16. Fuel 32 is delivered by fueling nozzle 30 into fuel fill-pipe 16 whence it runs into the vehicle fuel tank (not shown) as indicated by arrow 17. Adjacent end region 18 of fuel fill-pipe 16 is cap sensor 36 and nozzle sensor 38. Cap sensor 36 senses when cap 24 is mounted on fuel fill-pipe 16 and nozzle sensor 38 senses when fueling nozzle 30 is inserted into fuel fill-pipe 16. Further details of sensors 36, 38 are illustrated in FIGS. 2A–C. For convenience of illustration, sensors 36, 38 are shown as being mounted on end region 18 but this is not essential.

FIGS. 2A–D show enlarged end portions 18-1, 18-2, 18-3, 184 of end region 18 of fuel filler pipe 16 of FIGS. 1A–1C, providing further details according to several embodiments of the present invention. The threaded portion of cap 24 by which it couples to threads 20 of fill-pipe 16 is omitted in FIGS. 2A–D for convenience of illustration. FIGS. 2A–D differ in how cap sensor 36 and nozzle sensor 38 are implemented. While different embodiments are shown in FIGS. 2A–D, these are not intended to be limiting but merely to illustrate several ways in which the presence and absence of cap 24 and fueling nozzle 30 can be detected by cap sensor 36 and nozzle sensor 38 or combo sensor 368. Persons of skill in the art will appreciate based on the description herein, that many other types and arrangements of sensors may also be used for detecting cap 24 and fueling nozzle 30 besides those illustrated and it is intended to incorporate these alternatives in the claims that follow. What is important for the present invention is that sensors 36, 38, 368, detect the presence and absence of cap 24 and fueling nozzle 30.

Referring now to FIG. 2A showing end region 18-1, sensors 36-1, 38-1 are electromagnetic sensors using electromagnetic radiation and/or induction to detect the presence of cap 24 and fueling nozzle 30. For convenience of illustration, only portion 24-1 of cap 24 is shown in FIG. 1A. Electrical leads 37-1, 39-1 are coupled to sensors 36-1, 38-1 respectively. Mounted within portion 24-1 of cap 24 is region 40. As cap 24 moves toward or away from outer end 44 of fill-pipe 16 as shown by arrows 42, its presence or absence is detected by coil 36-1. This may occur in several ways. For example and not intended to be limiting, where region 40 is metallic, the AC impedance of sensor coil 36-1 changes as region 40 approaches sensor coil 36-1. Region 40 may be merely conductive or also magnetic and is preferably but not essentially annular in shape, but this is not essential. A ferro-magnetic or conductive region 40 will cause the AC impedance of sensor coil 36-1 to change as cap 24 is applied or removed from region 18-1 of fuel fill-pipe 16. Alternatively, sensor 36-1 can operate as a radio frequency identification tag (RFID) sensor and region 40 can be an embedded microchip RFID tag. Such devices are well known in the art. In FIG. 1A, sensor 38-1 for detecting fueling nozzle 30 as it moves in and out of opening 22 as shown by arrow 31 is depicted as being a coil type sensor utilizing electromagnetic radiation and/or induction to detect nozzle 30 by, for example, a change in impedance of sensor coil 38-1. With this arrangement, end region 18-1 is desirably non-metallic or at least not highly conductive to facilitate the electromagnetic radiation and/or induction penetrating to nozzle 30.

Referring now to FIG. 2B, showing end region 18-2, sensor 36-2 detects cap 24 as portion 24-2, moving as shown by arrows 42, approaches, impacts or depresses switch button or proximity detector 46 on sensor 36-2. For convenience of explanation, only portion 24-2 of cap 24 is shown in FIG. 2B. The status of switch or proximity detector 46 is read via leads 36-2. Sensor 38-2 is an electromagnetic sensor using electromagnetic radiation and/or induction to detect the presence of fueling nozzle 30. Electrical leads 39-2 are coupled to sensor 38-2. In the implementation of FIG. 2B, sensor coil 38-2 is desirably mounted inside end region 18-2 of fill-pipe 16 so as to be in closer proximity to nozzle 30. The AC impedance of sensor coil 38-2 changes as nozzle 30 moves into or out of fill-pipe 16 as shown by arrows 31. Nozzle 30 is usually made from a highly conductive non-sparking metal such as aluminum. The frequency of operation of sensor coil 38-2 is desirably selected to provide a significant change in coil impedance as fueling nozzle 30 is inserted and removed from fill-pipe 16.

Referring now to FIG. 2C showing end region 18-3, sensors 36-3, 38-3 are optical or acoustical sensors using optical or acoustic radiation to detect the presence of cap 24 and fueling nozzle 30. For convenience of illustration, only portion 24-3 of cap 24 is shown in FIG. 2C. Electrical leads 37-3, 39-3 are coupled to sensors 36-3, 38-3 respectively. Sensor 36-3 has emitter 50 and receiver 52, although they may be combined. Emitter 50 sends out optical or acoustic signal 54 that is reflected off face 45 of cap portion 24-3 as it approaches end 44 of fill-pipe 16, as shown by arrows 42. By measuring the change in reflected signal 54', the presence or absence of cap 24 is detected by sensor 36-3. Sensor 38-3 desirably comprises optical or acoustic emitter 60 that emits signal 61 toward generally opposed receiver 62. When fueling nozzle 30 is inserted in fill-pipe 16 to position 64, it interrupts beam 61, thereby causing receiver 62 to indicate that nozzle 30 is present in fill-pipe 16. While sensor 38-3 is illustrated as being a transmission type sensor, this is merely for convenience of explanation and not intended to be limiting. Sensor 38-3 may also be a reflective type where transmitter 60 and receiver 62 are not mounted in opposed arrangement, but so that receiver 62 can register signals reflected from nozzle 30 and use the change in reflected signal as nozzle 30 is inserted or withdrawn to detect its presence. Either arrangement is useful. With the arrangement of FIG. 2C, there is no limitation on the type of material used for fill-pipe 16, nor does operation of the system depend upon the material used for fueling nozzle 30. For example, nozzle 30 can be non-conductive and its presence will still be detected by sensor 38-3. The arrangement of FIGS. 2B and 2D will also detect a non-conductive nozzle 30 provided that the frequency of operation of coil (or other radiator) 38-2, 368 is sufficiently high that the presence of a non-conductive nozzle 30 provides additional loading of coil 38-2, 368 through an increase in local dielectric constant or permeability caused by nozzle 30 being inserted in fill-pipe 16 and/or fuel 32 flowing into fill-pipe 16.

While the implementations shown in FIGS. 2A–C have illustrated various types of sensors 36, 38 in combination, persons of skill in the art will understand that they need not be used merely in the pairings indicated in these figures but in various other combinations as well. For example, and not intended to be limiting, sensor 36-2 can be used in conjunction with sensor 38-3, and so forth among the other possible combinations. Sensor 38-3 is mounted immediately adjacent end 44 of pipe 16, which therefore gives an immediate response as nozzle 30, is inserted into opening 22. It will be appreciated by persons of skill in the art based on the description herein that sensors 38-1 and 38-1 can be similarly mounted adjacent end 44.

Figure 2D:
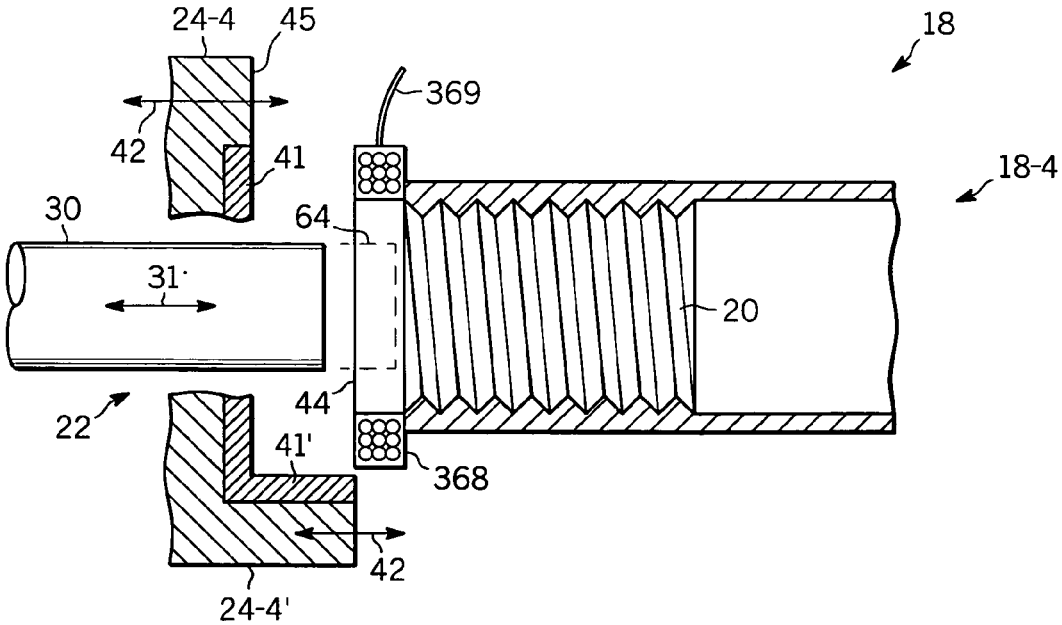

While FIGS. 2A–C illustrate arrangements in which two separate sensors 36, 38 are used to sense cap 24 and nozzle 30, this is not essential. Since fueling nozzle 30 cannot be inserted into fill-pipe 16 until after cap 24 is removed, it is possible to use a single sensor to detect both the removal of cap 24 and the insertion of fueling nozzle 30. This arrangement is illustrated, for example, in FIG. 2D showing end region 18-4. End region 18-4 has single coil-type sensor 368 mounted near end 44 of fill-pipe 16, preferably surrounding opening 22. In the upper half of FIG. 2D, Cap 24-4 is shown for example as including annular shaped ring 41, formed for example of ferrite. In the lower half of FIG. 2D, cap 24-4' is shown as having L-Shaped annular ring 41'. Many other shapes can also be used. The exact shape of region 41, 41' is a compromise between space and cost versus using the shape that produces the largest difference in impedance viewed at leads 369 when cap 24 is attached or removed. Coil sensor 368 uses electromagnetic radiation and/or induction to detect when cap 24 is in place on fill-pipe 16 and when fueling nozzle 30 is present in fill-pipe 16. Ring 41, 41' and fueling nozzle 30 have different electromagnetic signatures and are never both present at the same time. Different AC impedances will be observed at leads 369 for the different possible situations: (i) cap on, no fueling nozzle; (ii) cap off, no fueling nozzle; or (iii) cap off, fueling nozzle present. Sensor coil 368 can also be part of a tuned circuit that is sensitive to not only the changes in inductance of sensor coil 368 in response to the presence or absence of cap 24 and pipe 30, but also to changes in parasitic capacitance induced by cap 24 and/or pipe 30. Either arrangement is useful.

FIG. 3 is a simplified electrical schematic block diagram of control system 70 of the present invention for disabling the vehicle engine during fueling. Control system 70 comprises processor 72, fuel cap sensor 36 and fuel nozzle sensor 38 (or alternatively, combined sensor 368), user controls 74, memory 76, and engine control 78. As will be more fully explained later, fuel level sensor 82 and engine idle timer 84 are also desirably provided but these are not essential for all embodiments of the present invention. Fuel cap sensor 36 is coupled to processor 72 by leads or bus 37 and fueling nozzle sensor 38 is coupled to processor 72 by leads or bus 39. Alternative combined sensor 368 is coupled to processor 72 by leads or bus 369. User controls 74 are coupled to processor 72 by leads or bus 75, memory 76 is coupled to processor 72 by leads or bus 77, and engine control 78 is coupled to processor 72 by bus or leads 73. Engine control 78 is coupled to engine 80 by bus or leads 79. In the discussion that follows it will be understood that combined sensor 368 may be substituted for fuel cap sensor 36 and fuel nozzle sensor 38. Control system 70 governed by processor 72, monitors the status of sensors 36, 38, 368 to determine when cap 24 is removed from fill-pipe 16 and fuel nozzle pipe 30 inserted. When it detects either of those events, it instructs engine control 78 to disable engine 80, that is, if running shut it off and if not running, disable the engine start function. When processor 72 detects that fueling nozzle 30 has been removed and cap 24 restored on fill-pipe 16, then it instructs engine control 78 to re-enable engine start so that the vehicle once again behaves normally. The foregoing occurs automatically without user input or action. Memory 76 is provided to retain programming steps such as are described in FIG. 4 and temporary variables as needed to carry out the method of the present invention.

User controls 75 include at least an over-ride switch that disables the present invention in case of emergency in much the same way as over-ride switches are provided, for example, to disabling air-bag systems when a passenger might be harmed thereby. It is preferred that the disable switch be key-operated, much like most air-bag disable switches so that it is not accidentally set to the SYSTEM OFF position. A non-limiting example of when use of the over-ride switch might be needed is if cap 24 has been lost or stolen. Thus, activation of the appropriate user control should disable at least the fuel cap verification functions of the present invention. This can be done in various ways. For example and not intended to be limiting, by altering the signals received from sensor 36 so that they always indicate that fuel cap 24 is ON or changing the logical flow of method 100 of FIG. 4 to default to a NO (FALSE) response to any FUEL CAP OFF ? queries or equivalent in method 100 of FIG. 4. This is explained more fully in connection with method 100 of FIG. 4.

Fuel level sensor 82 is coupled to processor 72 by leads or bus 83 and engine idle timer 84 is conveniently coupled to engine control 78 by bus or leads 85. However, idle timer 84 may alternatively be a part of engine control 78 or be coupled to processor 72. Either arrangement works. Most modern cars already have the equivalent of fuel level sensor 82 and the equivalent of engine timer 84 that provide data on fuel level and engine idle time to the on-board engine or power train management system. By monitoring the engine idle time and fuel level in the fuel tank, system 70 can determine with reasonable accuracy whether or not the vehicle is being fueled, and therefore disable engine 80 as discussed above. For example, if the fuel level in the fuel tank is increasing by at least amount $R(t)=Rc$ per unit time where Rc is a predetermined threshold fueling rate parameter, then this is generally a positive indication that the vehicle is being fueled. If engine 80 is running it should be shut off and kept off as long as the fueling rate $R(t)$ is at least Rc. It is also useful to monitor the engine idle time using timer 84. Operation of system 70 utilizing fuel level sensor 82 and idle timer 84 will be more fully understood by reference to method 200 of FIG. 5.

Processor 72, engine control 78, memory 76 and idle timer 84 are shown as separate but interconnected elements in system 70 of FIG. 3, but this is merely for convenience of description and not intended to be limiting. The partitioning of functions among processor 72, engine control 78, memory 76 and idle timer 84 is a matter of design choice. Persons of skill in the art will understand that these functions may be combined in a single processor or controller or control processor or that engine or power train management systems already present in many vehicles can be used to provide these functions. What is important is that these functions be present in system 70 not that they have a particular architecture or implementation. Hence such variations are intended to be included in the claims that follow and the words "processor" or "controller" or "control processor" are intended to have this broader meaning and not be limited merely to the configuration shown in FIG. 3.

Figure 5:
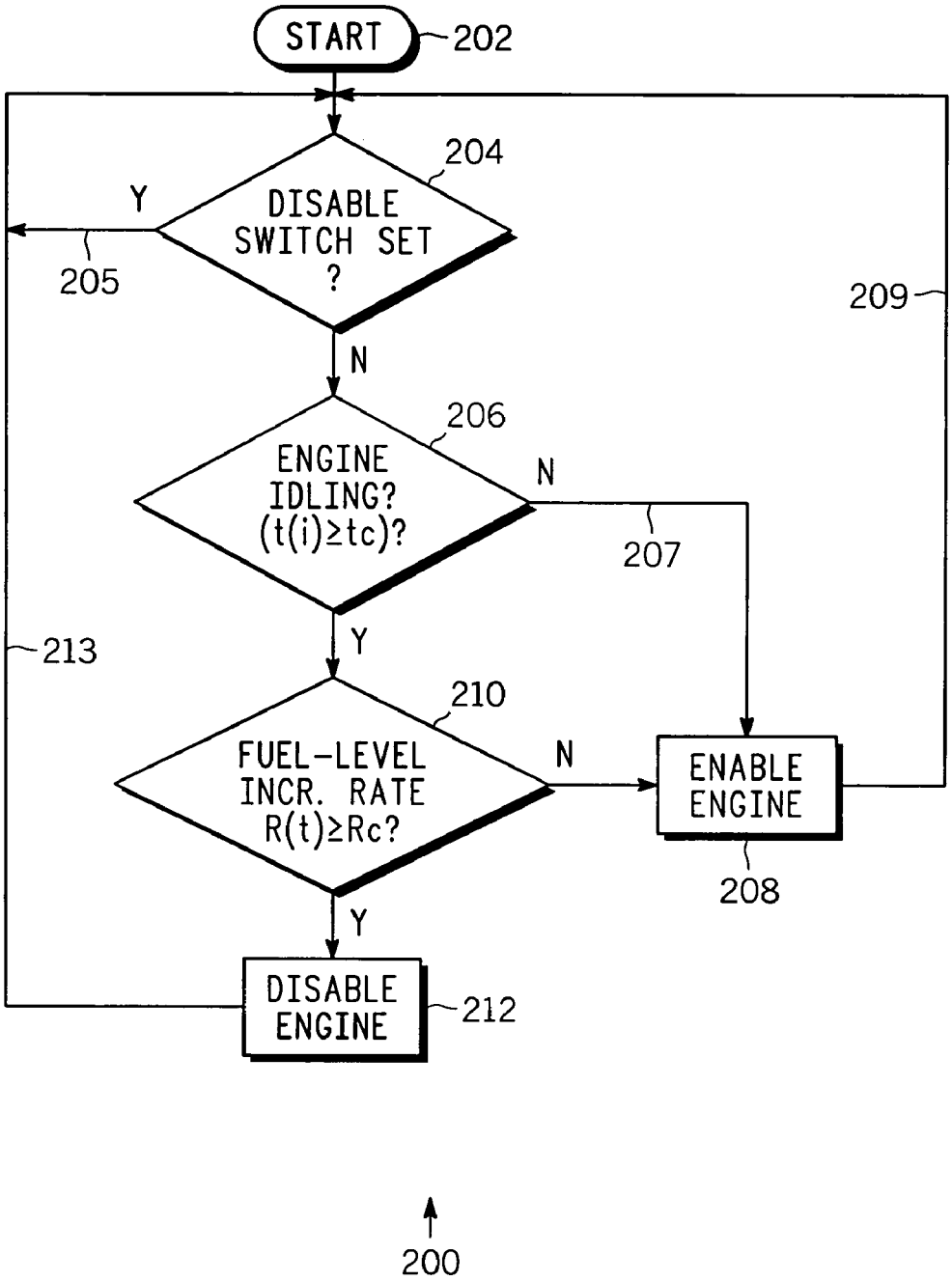
FIG. 5 is a simplified flow chart of the method of the present invention according to further embodiment.

FIG. 4 is a simplified flow chart of method 100 of the present invention, according to a first embodiment. In FIGS. 4–5, the logical outcome YES (TRUE) is abbreviated as "Y" and the logical outcome NO (FALSE) is abbreviated as "N". Method 100 begins with start 102 that desirably occurs on vehicle power-up, for example, when the key inserted in the ignition switch or the doors unlocked or other minimal vehicle function energized. It is preferable that START not depend upon the position of the ignition switch. Method 100 then proceeds to optional DISABLE SWITCH SET ? query 104 wherein it is determined whether or not the disable switch in user controls 74 has been activated. If the outcome of query 104 is YES (TRUE) indicating that the user has disabled the aspect of system 70 that checks for the presence of cap 24, then method 100 proceeds to FUEL NOZZLE IN FILL PIPE ? query 106. This is accomplished by processor 72 interrogating sensor 38 or 368 to determine whether fueling nozzle 30 is in fill-pipe 16. If the outcome of query 106 is NO (FALSE) indicating that fueling nozzle 30 is not inserted in fuel fill-pipe 16, then method 100 proceeds to ENABLE ENGINE step 108 wherein processor 72 directs engine control 78 to allow engine 80 to continue to run if running or to be started if not running. From ENABLE ENGINE step 108, method 100 returns to start 102 and initial query 104 as shown by path 109. Thus, when the disable switch has been SET, the vehicle engine will only be disabled if fueling nozzle 30 is present in fill-pipe 16. Activating (i.e., SETTING) the disable switch in user controls 74 makes system 70 insensitive to the status of cap 24.

If the outcome of query 106 is YES (TRUE) indicating that a fueling operation is either about to begin or is underway, then method 100 proceeds to DISABLE ENGINE step 112. In step 112 if engine 80 is not running it is prevented from starting and, if engine 80 is running, it is shut off. This is accomplished by processor 72 sending appropriate commands to engine control 78.

Returning now to query 104, if the outcome of query 104 is NO (FALSE) indicating that the disable switch is not SET (i.e., not activated), then method 100 proceeds to FUEL CAP OFF ? query 110 wherein processor 72 determines by interrogating sensor 36 or 368 whether or not cap 24 is installed on fill-pipe 16. If the outcome of query 110 is NO (FALSE) indicating that cap 24 is still on fill-pipe 16, the method 100 advances to ENABLE ENGINE step 108 and proceeds as described earlier. If the outcome of query 110 is YES (TRUE) indicating that cap 24 has been removed from fill-pipe 16, then method 100 proceeds to DISABLE ENGINE step 112 wherein, engine 80 is prevented from operating as long as fuel cap 24 is off of fill-pipe 16 (unless the disable switch is SET which bypasses this query). Following step 112 method 100 returns to start 102 and initial query 104 as shown by path 115. As long as the system is energized it will cycle through method 100 and maintain the vehicle in an ENGINE-OFF condition if the fuel cap is off and the fueling safety by-pass switch is not SET, or even if the by-pass switch is SET, it will maintain the vehicle in an ENGINE-OFF condition as long as fueling nozzle 30 is in fill-pipe 16. Thus, system 70 maintains the vehicle in a safer fueling state while accommodating foreseeable emergencies. While the forgoing description illustrates the use of both cap ON/OFF detection and fuel filling nozzle IN/OUT detection, this is not essential. Although using both sensors is preferred, fueling safety is also improved by using either one alone. Thus, the present invention also includes a system where either cap sensor 36 is provided or nozzle insertion sensor 38 is provided or both are provided, depending upon the needs of the designer.

FIG. 5 is a simplified flow chart of method 200 of the present invention according to a further embodiment of the present invention. Method 200 begins with start 202 that desirably occurs when the vehicle is started or the ignition left in the start or run position. Method 200 then proceeds to optional DISABLE SWITCH SET ? query 204 wherein it is determined whether a disable switch among user controls 74 has been activated. (This is analogous to step 104 of method 100.) If this disable switch has been SET (query 204 yields YES (TRUE)), then method 200 returns to start 202 as shown by path 205 and the fueling safety features provided by system 70 and method 200 are not active. Use of query 204 and its associated disable switch is not essential but is desirable for those vehicles that may encounter very unusual circumstances. An example of such circumstances is with vehicles operating in extremely cold arctic weather where it is important to keep the engine operating even while fueling, or during military operations or other emergency situations, where the risk of engine or vehicle failure from the unusual conditions outweighs the increased hazard from engine operation during fueling. However, these are generally rare situations.

If the outcome of query 204 is NO (FALSE) indicating that the disable switch has not been SET, then method 200 proceeds to ENGINE IDILING ? ($t(i) \geqq tc$) ? query 206. In query 206 it is determined whether or not the engine is running, e.g., idling. In the preferred embodiment, it is also determined whether or not the engine idle time t(i) equals or exceeds a predetermined idle time tc, but this is not essential. The parameter tc is preferably chosen to represent the typical time it takes a driver to exit the vehicle and begin fueling and is usefully in the range of about 5 to 50 seconds, more conveniently about 10 to 30 seconds and preferably about 15 to 25 seconds, but larger or smaller values can also be used. If the outcome of query 206 is NO (FALSE) indicating that engine 80 is not idling, or alternatively has not been idling for at least time $t(i)=tc$, then method 200 proceeds to ENABLE ENGINE step 208 wherein if engine 80 is running it continues to run or if engine 80 is not running, it may be started. Using query 206 in the form that determines whether idle time t(i) at least equals tc is preferred.

If the outcome of query 206 is YES (TRUE) indicating that engine 80 is running or that it has been idling for at least time $t(i)=tc$ then method 200 proceeds to FUEL-LEVEL INCREASE RATE $R(t)>Rc$ ? query 210 wherein processor 72 uses fuel level sensor 82 to determine whether the increase in fuel level per unit time (i.e., the fueling rate R(t)) exceeds a predetermined fueling rate Rc. The parameter Rc may be stored in memory 77 or elsewhere in the vehicle electronics system and expressed in liters per second or gallons per minute or percent change per minute or second, or in whatever other units the system designer finds convenient. The sampling periods for determining R(t) should be long enough that transient sloshing of the fuel in the tank does not give false readings indicating fueling when none is actually taking place. If the outcome of query 210 is NO (FALSE) indicating that $R(t)<Rc$, then method 200 proceeds to ENABLE ENGINE step 208 wherein engine 80 continues to run if already running or is allowed to start if not running, as has been previously explained.

If the outcome of query 210 is YES (TRUE) indicating that $R(t) \geqq Rc$, then method 200 proceeds to DISABLE ENGINE step 212 wherein engine 80 is shut off if running and prevented from started if not running. ENABLE ENGINE and DISABLE ENGINE are conveniently accomplished by engine control 78 in conjunction with processor 72. Predetermined fueling rate parameter Rc is conveniently stored in memory 76 and is best chosen by the designer to avoid significant false positives from fuel sloshing and the like. The magnitude of Rc and the time period over which it is measured will depend upon the details of the fuel tank design on a particular vehicle, among other things, the capacity of the tank, whether anti-slosh baffles or sponges are included in the tank, the sensitivity and stability of fuel level sensor 82 and other factors that will be understood by persons of skill in the art. Thus, Rc is conveniently chosen by the designer based on the properties of the particular vehicle being fitted or designed with the present invention. Following DISABLE ENGINE step 212, method 200 returns to start 202 and initial query 204 as shown by path

213. Unless the disable switch is SET, method 200 will substantially maintain the vehicle in an ENGINE DISABLED (e.g., OFF) state during fueling and return it to an ENGINE ENABLED (e.g., ON or START ALLOWED) state when fueling is finished.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A system for disabling a vehicle engine during fueling operations, comprising:

one or more sensors for providing an output indicating whether a cap for closing a fuel fill-pipe of the vehicle is ON (closed) or OFF (open);

a processor coupled to the one or more sensors for receiving the output thereof;

an engine control coupled to the processor and the engine for disabling the vehicle engine when the output of the one more sensors indicates that the fuel fill-pipe cap is OFF;

wherein the one or more sensors also provide an output indicating whether a fueling nozzle has been inserted in the fuel fill-pipe of the vehicle.

2. The system of claim 1 further comprising a disable switch that allows the vehicle to operate even when the fuel fill-pipe cap is OFF, wherein the engine is allowed to operate unless the one or more sensors detect that a fueling nozzle has been inserted in the fuel fill-pipe of the vehicle.

3. A method for limiting vehicle engine operation during fueling, comprising:

testing whether a fuel-cap function by-pass switch is ON (YES) or OFF (NO), and if NO;

determining if the fuel-cap is OFF the fuel fill-pipe of the vehicle;

and if NO, enabling operation of the engine of the vehicle, and and if YES, disabling operation of the vehicle engine; and if the fuel cap function by-pass switch is ON;

determining if a fuel supply nozzle is in a fuel fill-pipe of the vehicle, and if YES, disabling operation of the vehicle;

and if NO, enabling operation of the vehicle.

4. The method of claim 3 wherein the first determining step is performed using a first sensor and the second determining step is performed using a second sensor.

5. The method of claim 3 wherein the first and second determining steps are performed using the same sensor.

6. A system for limiting vehicle engine operation during fueling, comprising:

an engine control for enabling or disabling operation of the engine;

one or more sensors for detecting whether a fueling nozzle is inserted in the vehicle fuel fill-pipe;

a processor coupled to the engine control and the one or more sensors for receiving inputs from the one or more sensors and directing the engine control to enable or disable the vehicle engine depending upon the inputs received from the one or more sensors; and wherein, when the fueling nozzle is in the vehicle fuel fill-pipe, the engine is disabled.

7. The system of claim 6 further comprising, re-enabling the engine when the fueling nozzle not in the fuel fill-pipe.

8. The system of claim 6 wherein the one or more sensors detect whether a cap is on the fuel fill-pipe and the processor disables the engine when the cap is not on the fuel fill-pipe and re-enables the engine when the cap is on the fuel fill-pipe.

9. A system for limiting vehicle engine operation during fueling, comprising:

a fuel level sensor;

an engine control processor coupled to the fuel level sensor and the engine for determining a rate of change of fuel level R(t) and when R(t) equals or exceeds a predetermined value Rc, disabling the engine;

an idle timer coupled to the control processor for measuring the time duration t(i) during which the engine has been idling, wherein the control processor disables the engine when $R(t) \geqq Rc$ and $t(i) \geqq tc$ where tc is a predetermined idle time.

10. A method for limiting operation of a vehicle engine during fueling comprising:

determining whether a change in fuel tank level R(t) exceeds a predetermined threshold value Rc; and if $R(t) > Rc$, disabling the engine; and if $R(t) < Rc$, not disabling the engine;

determining whether or not the engine has been idling for time $t(i) \geqq tc$ where tc is a predetermined threshold value; and if $t(i) \geqq tc$ and $R(t) \geqq Rc$, disabling the engine; and if $t(i) < tc$ or $R(t) < Rc$, enabling the engine.

* * * * *